US005791181A

United States Patent [19]

Sperber et al.

[11] Patent Number: 5,791,181

[45] Date of Patent: Aug. 11, 1998

[54] LOCKING SYSTEM, PARTICULARLY FOR MOTOR VEHICLES AND BUILDING FIXTURES

[75] Inventors: Alfred Sperber; Bernd Sperber, both of Bamberg, Germany

[73] Assignee: Valeo GmbH & Co. Schliessysteme KG, Heiligenhaus, Germany

[21] Appl. No.: 591,658

[22] PCT Filed: Jun. 8, 1995

[86] PCT No.: PCT/EP95/02209

§ 371 Date: Feb. 12, 1996

§ 102(e) Date: Feb. 12, 1996

[87] PCT Pub. No.: WO95/34731

PCT Pub. Date: Dec. 21, 1995

[30] Foreign Application Priority Data

Jun. 10, 1994 [DE] Germany ..... 44 20 372.1

[51] Int. Cl.[6] ..... E05B 27/08

[52] U.S. Cl. ..... 70/383; 70/384; 70/491; 70/496

[58] Field of Search ..... 70/491, 495, 496, 70/382–385, DIG. 2, DIG. 9, DIG. 22, DIG. 44, DIG. 75

[56] References Cited

U.S. PATENT DOCUMENTS

| | | | |
|---|---|---|---|
| 1,366,161 | 1/1921 | Clark . | |
| 1,661,982 | 3/1928 | Wanat . | |
| 1,720,838 | 7/1929 | De Castro É Iznaga | 70/491 |
| 2,021,443 | 11/1935 | Deutsch | 70/384 |
| 2,044,534 | 6/1936 | Lejbowicz | 70/383 |
| 2,142,610 | 1/1939 | Kittler | 70/384 |
| 2,390,471 | 12/1945 | Suter | 70/385 |
| 3,486,353 | 12/1969 | Pilvet | 70/496 |
| 3,817,066 | 6/1974 | Pearson | 70/491 |
| 3,868,838 | 3/1975 | Zimmerman et al. | 70/383 |
| 4,064,720 | 12/1977 | Fry | 70/496 |
| 5,209,088 | 5/1993 | Vaks | 70/384 |

FOREIGN PATENT DOCUMENTS

| | | | |
|---|---|---|---|
| 0226252 | 6/1987 | European Pat. Off. . | |
| 0280747 | 9/1988 | European Pat. Off. . | |
| 2531127 | 2/1984 | France | 70/491 |
| 469833 | 12/1928 | Germany | 70/384 |
| 3827148 | 2/1990 | Germany . | |
| 4134990 | 4/1993 | Germany . | |
| 696 | 1/1912 | United Kingdom | 70/382 |
| 639024 | 6/1950 | United Kingdom | 70/491 |
| 1050121 | 12/1966 | United Kingdom | 70/496 |

*Primary Examiner*—Lloyd A. Gall
*Attorney, Agent, or Firm*—Spencer & Frank

[57] ABSTRACT

A novel locking system of the type which has very useful properties and at the same time can be produced cost-effectively, and is therefore suitable to be a mass-produced product, particularly for use in motor vehicles and building fixtures. The latching element comprises a carrier (3, 3') and a rider (4, 4') which are displaceable toward each other and are in frictional or form-fitting engagement, with a latching recess (41) that is associated with the latch (51) being cut into the rider (4, 4') and a stop surface (43) which is engaged by a stop element (7) in the uncoded zero position of the latching element being provided at the free end, and that a spring/fixing element (6) is provided which is supported on the one hand against the inside base surface (200*b*) of the base body (2*b*) of the locking core (2) and, on the other hand, on against the carrier (3, 3'), and that the spring/fixing element (6) can be brought into a fixing position in which the relative position of carrier (3, 3') and rider (4, 4') is fixed and the stop element (7) is removed from engagement with the stop surface (43) of the rider (4, 4').

22 Claims, 7 Drawing Sheets

LOCKING SYSTEM, PARTICULARLY FOR MOTOR VEHICLES AND BUILDING FIXTURES

BACKGROUND OF THE INVENTION

The invention relates to a novel locking system according to the preambles to claims 1 and 17 which has very useful properties and at the same time can be produced cost-effectively, and is therefore suitable to be a mass-produced product, particularly for use in motor vehicles and building fixtures.

A cylindrical lock whose secret key code can be changed and in which, instead of the key bit, at least two adjustment rings which can assume defined positions in the axial direction inside the lock cylinder are provided on the key shaft is known from DE 20 41 368 B2. In this instance, the adjustment rings of the key are allocated rotatable locking rings of the lock cylinder. Radially-oriented latching notches of the adjustment rings correspond with spring-loaded locking pins of the locking rings in such a way that it is only possible to operate the locking system if the key fits. This cylinder lock permits new programming of the code in a simple manner after insertion of the key; however, the structural design is very complicated and the lock assembly is correspondingly involved. The large number of intended code variations results in a likewise large number of latching notches, locking pins and springs, which leads to an increasing tolerance sensitivity. An embodiment of the described system in a lock cylinder having a comparatively small diameter hardly appears possible, so its use in motor vehicles is hardly an issue.

In DE 41 34 990 C1 a locking apparatus is described whose cylinder lock has a two-part locking core which is freely rotatable in the cylinder housing. Seated therein are blocking elements which are axially displaced, counter to the pressure of springs, by plungers of a key which can be inserted through a shaft. If the key code matches the code of the locking core, the latching recesses of the blocking elements form a common alignment directly beneath the latch of a blocking element, so that the two can enter into form-fitting engagement in the case that the key is rotated in order to operate the locking system. If a key which does not fit is used, the blocking element cannot leave the recess in the cylinder housing, which prevents a rotation of the locking core.

The described locking system can be programmed to a new code, but it requires an exchange, or at least a new arrangement, of the blocking elements. Because a specific blocking element is associated with each individual code (of the entire code of the locking system), assembly must be performed with the highest degree of carefulness.

The object of the invention is to develop a locking system which is distinguished by a simplified design and ability to be produced cost-effectively. Moreover, the locking core is intended to be programmable to the code of the key the first time the key is inserted, and/or the locking system is intended to be operable from one side—regardless of the code of the locking core and whether a key is completely or partially inserted from the other side—by a handle integrated into the locking system (e.g. for the purpose of emergency operation).

SUMMARY OF THE INVENTION

According to the invention, the above object is accomplished by a lock cylinder and a key which can be inserted into it and has plungers which point in directions of insertion, with the two-part latching element comprising parts which can be displaced toward each other and are fixed with respect to each other in a locking position. These parts, which are referred to as carrier and rider, are in form-fitting or frictional engagement. When a key that is able to fit is inserted, a latch opening cut into the rider faces a latch formed on a blocking element. The blocking element is seated to be radially displaceable in a recess of the locking core, and, in the zero position, extends into a further recess disposed in the housing which serves to block the locking system in the event that, when a key which does not fit is used, the latch of the blocking element cannot be pushed into the latching recesses of the individual carriers.

The locking system according to the invention is first assembled in an uncoded zero position, that is, the latching element comprising a carrier and a rider has a length which at least corresponds to the smallest code value when the provided key is inserted. In this case, the relevant plunger of the key would not displace the latching element seated counter to an axially-acting spring.

To the greatest possible extent, in the uncoded zero position the latching elements fill the space between a locking-core-side stop surface on the side of the shaft for key insertion and a stop surface of a stop element located opposite. The insertion of the key causes the plungers of the key to press against the spring-loader carriers, and push them different distances in the axial direction, corresponding to the respective plunger length. Because the riders are supported against a stop element, the position of carrier and rider relative to each other is simultaneously shifted. After the key has been completely inserted, the key code is imparted to the locking core, that is, a displacement of carrier and rider with respect to each other, and thus an adequate shortening of the individual latching elements, has taken place corresponding to the graduation of the length of the key plungers.

Following completion of the coding process by means of the first-time insertion of the key and its removal from the shaft of the lock cylinder, compression springs which act on the carriers of the latching elements push each individual latching element against a front stop surface on the side of the key shaft. In this "inoperative position," the latching recesses of the riders do not create a flush alignment (transversely-extending channel) into which the latch (transversely-extending rib) of the blocking element can be inserted. Due to the displacement of carrier and rider with respect to each other during the coding process, the latching recesses of the individual latching elements are now located at different axial distances, e.g. measured from the front stop surface against which the latching elements are supported when in their inoperative position.

All of the latching recesses are preferably located at the same height and directly opposite the latch of the blocking element in the uncoded zero position, in which the free ends of the riders should be in direct proximity to the stop element. In this constellation, the locking system can also be operated without a coding process to be performed in advance. To this end a key is used which has no plungers but cannot engage the latching elements so as to displace them. With careful handling, operation can also be effected with other objects, such as a screwdriver.

The spring force of a spring/fixing element which is seated between the latching elements and one part of the two-part base body of the locking core assures a permanent, but nevertheless displaceable, engagement between carriers and riders until completion of the coding process.

Afterwards, the position of carrier and rider with respect to each other that is imparted to the key can be fixed. This is effected by the displacement of the spring/fixing element in the axial direction, which is intended to prevent not only further displacements between the parts of the latching elements (carrier and rider) which are preferably in form-fitting engagement. At the same time, the stop element against which the free ends of the riders are supported during the coding process is dislocated. This is necessary to assure sufficient axial displaceability of the coded latching elements during operation of the lock.

The displacement of the spring/fixing element from its spring position into the fixing position can be effected by, for example, a pushing pin which is connected on the one hand with the spring/fixing element and, on the other hand, penetrates the front plate of the lock cylinder in the spring position. The spring/fixing element reaches its fixing position by means of the pushing in of the pushing pin.

A further variation of the invention which is independent of the above-described variation, but can also be combined with it, is described in independent subclaim 17. This claim provides that an opening/closing bar is disposed on one of the two sides of the lock cylinder and engages associated stop surfaces of the latching elements during operation, preferably as an integral component of the lock cylinder. The stop surfaces of all of the latching elements are at identical distances from their latching recesses. When the opening/closing bar reaches a stop position on the side of the housing, all of the latching recesses are located in the engagement position with respect to the latch of the blocking element, so that a rotational movement of the locking core can be executed.

The described variation is particularly suited for use in building fixtures as an emergency or panic locking system which permits problem-free operation, even if the locking system is in the locked position or if the key is inserted into the shaft of the lock cylinder on the opposite side.

Hence, a locked space can always be unlocked from the side of the opening/closing bar.

Inside the lock cylinder, the opening/closing bar preferably has a rib which extends transversely to the axis of the lock, and enters engagement with the associated stop surfaces of all latching elements and allocates the latching recesses to the latch when the opening/closing bar is drawn into its stop position on the side of the housing. A rotation of the opening/closing bar or the lock core, and thus the execution of the unlocking or locking process, is subsequently possible.

In the combination of the invention features in claims 1 and 17, a locking system is obtained which can be coded from an uncoded zero position of the lock cylinder by a key when it is inserted for the first time, but also has the advantage of emergency operation from one side of a space to be locked.

At this point it is noted that the code of the described locking system can be reset after removal of the locking core. In particular, it is also possible to perform new coding, again by means of a key, after the latching elements comprising carriers and riders have been brought again into the uncoded zero position.

BRIEF DESCRIPTION OF THE DRAWINGS

The invention is described in detail below in conjunction with embodiments and the illustrated figures, wherein.

DETAILED DESCRIPTION OF THE PREFERRED EMBODIMENTS

Figure 1A:
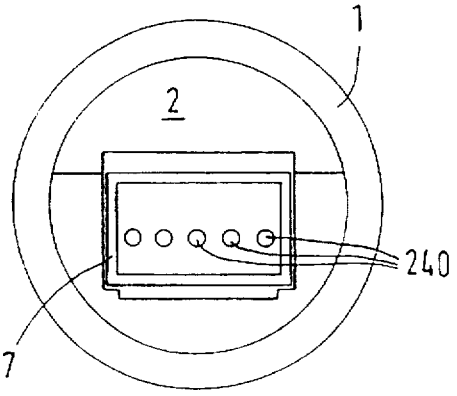
FIG. 1*a* is a view of the end face of the locking system (rear side) facing away from the key-side end face.
Figure 1B:
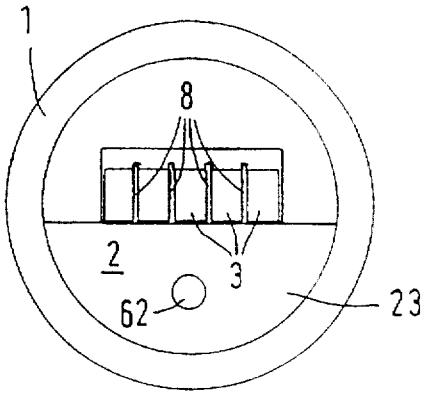
FIG. 1*b* is a view of the key-side end face of the locking system (front side)
Figure 1:
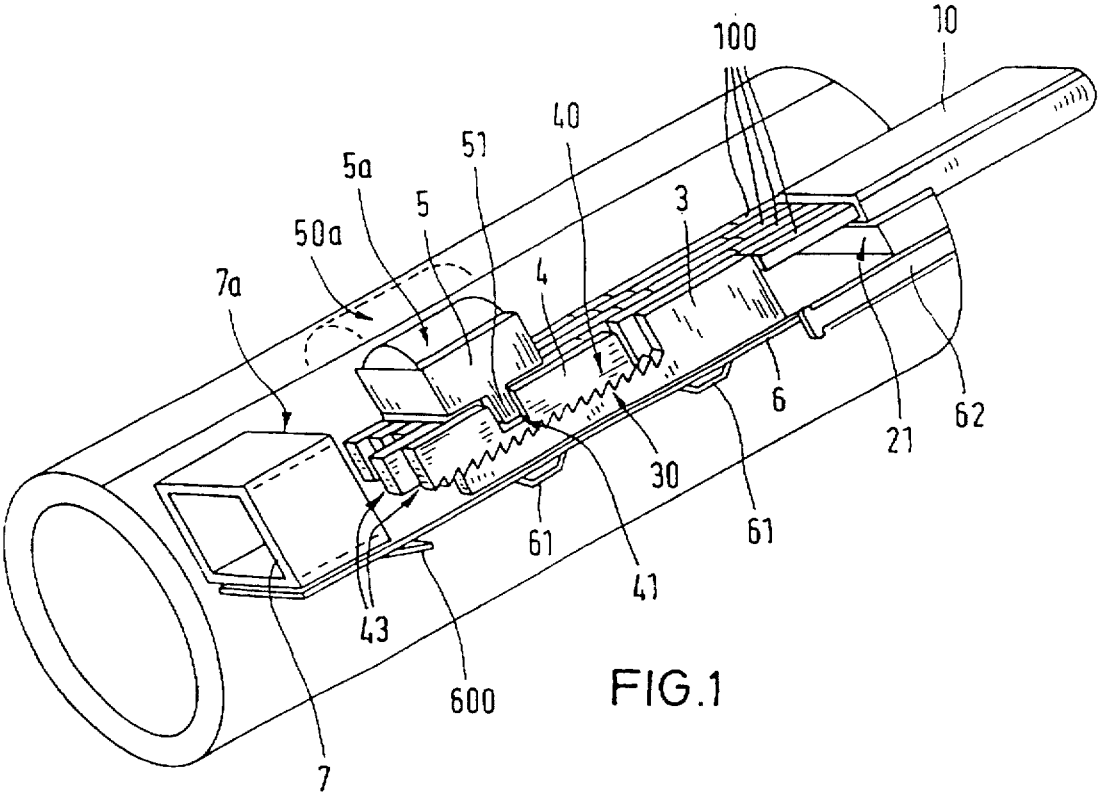
FIG. 1 is a schematic representation in perspective of a locking system according to the invention which can be programmed by a key, in the coded state with a locked code.
Figure 2A:
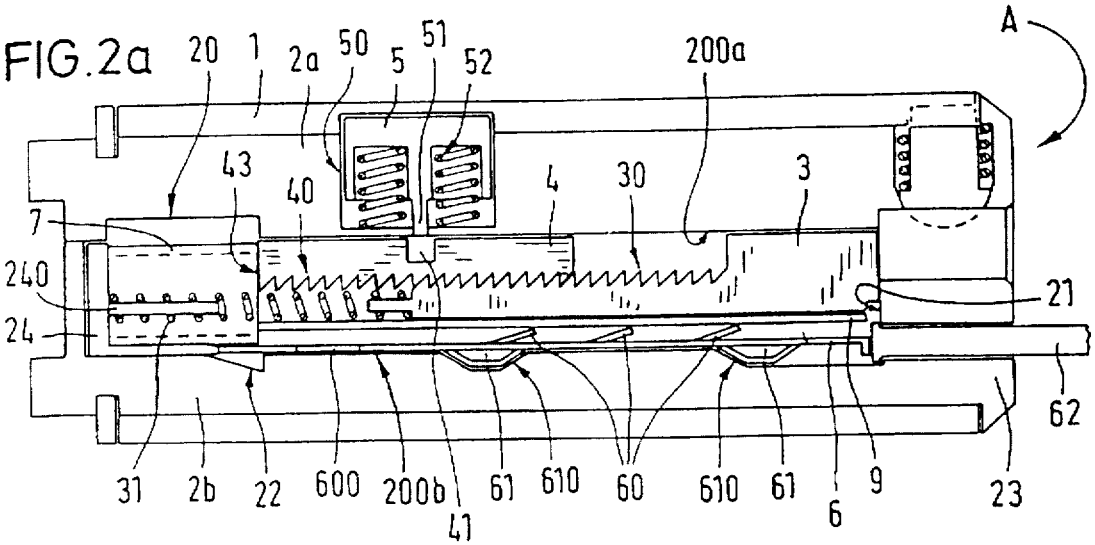
FIG. 2*a* is a cross-section through a locking system according to FIG. 1, in the uncoded zero position.
Figure 2B:
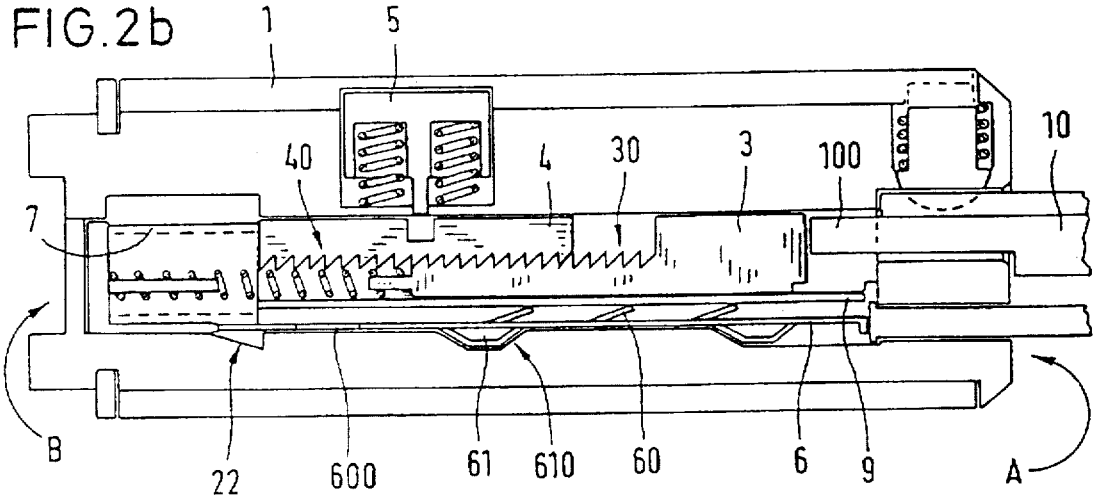
FIG. 2*b* is a cross-section through a locking system according to FIG. 1, with a completely inserted key, in the coding position.
Figure 2C:
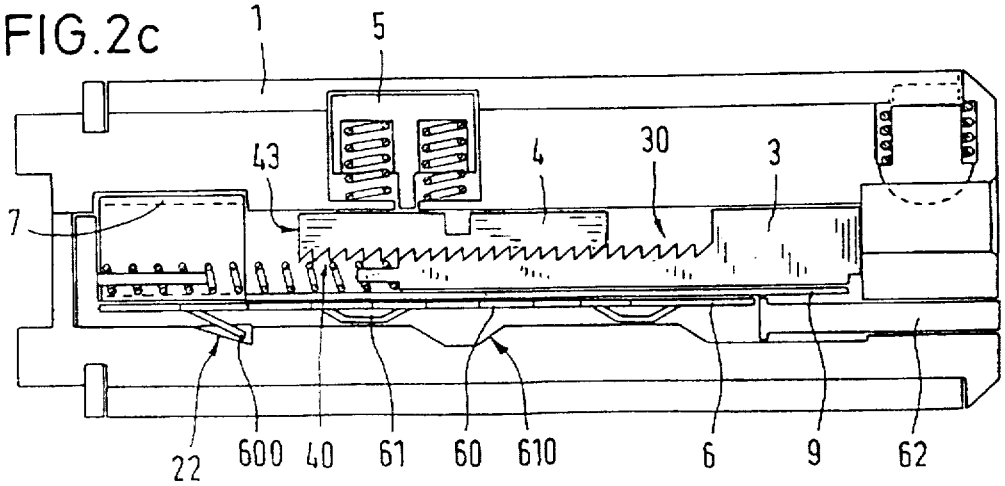
FIG. 2*c* is a longitudinal cross-section through a locking system according to FIG. 1, having a locked code of the programmed locking core, in the inoperative position.

The design and function of the locking system of the invention which can be coded by a key are illustrated in FIGS. 1 through 2*c*. The schematic representations illustrate an embodiment variation of the principle of the invention that includes form-fitting engagement between the carrier 3 and the rider 4 of a latching element.

A two-part (axially-divided) locking core 2 comprising a part 2*a* and a part 2*b* is seated inside the cylindrical housing 1. It receives all of the other components of the locking system that are important for function, and guides them during operation.

A recess 50, in which the blocking element 5 is guided to move radially, is cut into the part 2*a*. A spring 52 presses the blocking element 5, with its rooflike head region 5*a*, radially outwardly against the wall of the housing 1. In the neutral position of the locking core, in which the key can be inserted and removed, the recess 50 corresponds to the recess 50*a* in the housing 1. Only if the blocking element 5 is able to be lowered counter to the pressure of the spring 52 can the locking core be rotated.

The other part 2*b* of the locking core supports the latching elements comprising carriers 3 and riders 4. A glide plate 9 and a spring/fixing element 6, however, are disposed between them. The spring/fixing element 6 can be formed from a stamped, bent component from a piece of sheet steel or plastic. Support blocks 61 embodied rigidly on the spring/fixing element 6 extend outwardly in the radial direction, while spring tongues 60 extend in the opposite direction and support the latching elements (comprising carrier 3 and rider 4) above the glide plate 9. Recesses 610 for receiving the support blocks 61 are provided in the part 2*b* as long as the spring/fixing element 6 has not yet been displaced into its fixing position (see FIG. 2*c*) and is still located in its spring position (see FIGS. 2*a* and 2*b*).

The rear end of the part 2*b* is limited by the floor 24, which carries a number of receiving pins 240 corresponding to the number of latching elements, the pins being provided for support of compression springs 31 which are each supported against the carrier 3 on the other side and thus press the latching elements against the stop surface 21 in the region of the front plate 23. The stop element 7 is also supported against the inside wall of the floor 24; the stop surface 7*a* of the stop element is associated with the free ends of the riders 4 until the spring/fixing element 6 is displaced into the fixing position and lifts the blocking element 7 into a recess 20 in the part 2*a*. According to the present embodiment, the blocking element 7 possesses the contour of a rectangular box having open end faces on both sides.

FIG. 2*a* shows a lock cylinder having a locking core in the uncoded zero position. In this instance, the latching element 3, 4 completely fills the space between the front stop surface 21 and the rear stop element 7. The spring/fixing element 6 is located in the spring position and supports the latching elements by way of the glide plate 9. The latching recesses 41 lie directly opposite the latch 51 of the blocking element 5 and form a transversely-extending channel into which the latch 51 can be lowered. It is therefore also possible to operate the locking system in the uncoded zero position, e.g. with a screwdriver.

As can be seen from FIG. 2*b*, a key 10 having plungers 100 that point in the direction of insertion is inserted completely (until it stops) into the shaft of the locking core on the side A. Consequently, the carriers 3 were displaced in the axial direction and, relative to the rider 4, counter to the force of the spring 31 corresponding to the length of the respective plunger 100, which is tantamount to the coding of the locking core; the code of the key 10 was consequently transferred to the locking core.

Carrier 3 and rider 4 are connected form-fittingly with each other by way of their toothing 30, 40. It is configured in sawtooth form, with the less steep edges of the toothing 30, 40 pointing in the direction of displacement of the parts 3, 4. The division of the toothing preferably corresponds to the spacing of two adjacent code values.

FIG. 2*c* shows the locking system with the fixed code of the locking core. To this end the pushing pin 62 projecting outwardly through the front plate 23 was pushed into the interior, causing the spring/fixing element 6 to be analogously displaced. Now the support blocks 61 are supported on the inside base surface 200*b* of the part 2*b* and essentially fill the distance previously bridged by the spring tongues 60. The spring tongues 60 are consequently pressed substantially flat and assure no more play for relative movement between carrier 3 and rider 4. They can therefore no longer be displaced toward each other.

The blocking element 7 is also lifted by the lifting of the spring/fixing element 6, which causes the stop surface 7*a* to be removed from the free end of the rider. Now the latching element can be displaced beyond the stop surface 7*a*. It is no longer possible to ascertain the original zero position.

Moreover, in the (lifted) fixing position of the spring/fixing element 6, a detent spring 600 can pivot downwardly; this spring engages an associated cutout 22 in the part 2*b* and thus prevents the release of the fixing of the code of the locking core without disassembly of the locking system. Under these circumstances, the one-piece embodiment of spring/fixing element 6 and pushing pin 62 is also not critical.

Figure 2D:
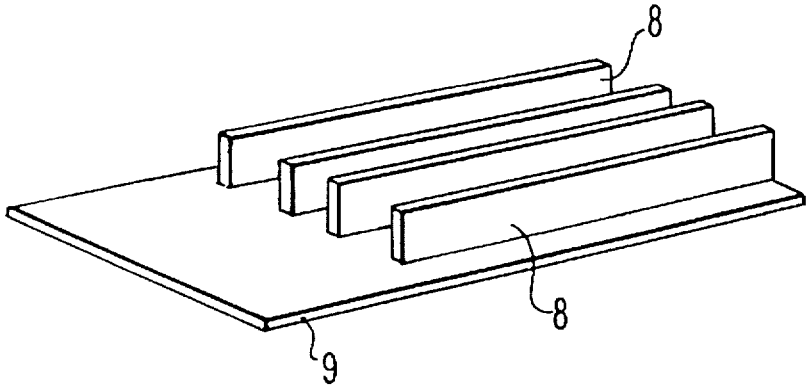
FIG. 2*d* is a perspective view showing the one piece component of the glide plate and the spacers for the locking system in FIG. 1.

In order to assure good mobility of the spring-supported latching elements 3, 4 at all times, distancing or spacing elements 8 are seated between the adjacent latching elements; the height of these distancing elements 8, which extend between the inside base surface 200*a* of the part 2*a* and the glide plate 9, should be slightly greater than the height of the latching element comprising carrier 3 and rider 4 as can be seen in FIG. 1*b*. The glide plate 9 and the distancing elements 8 can also be configured as a one-piece component as shown in FIG. 2*d*.

Figure 3:
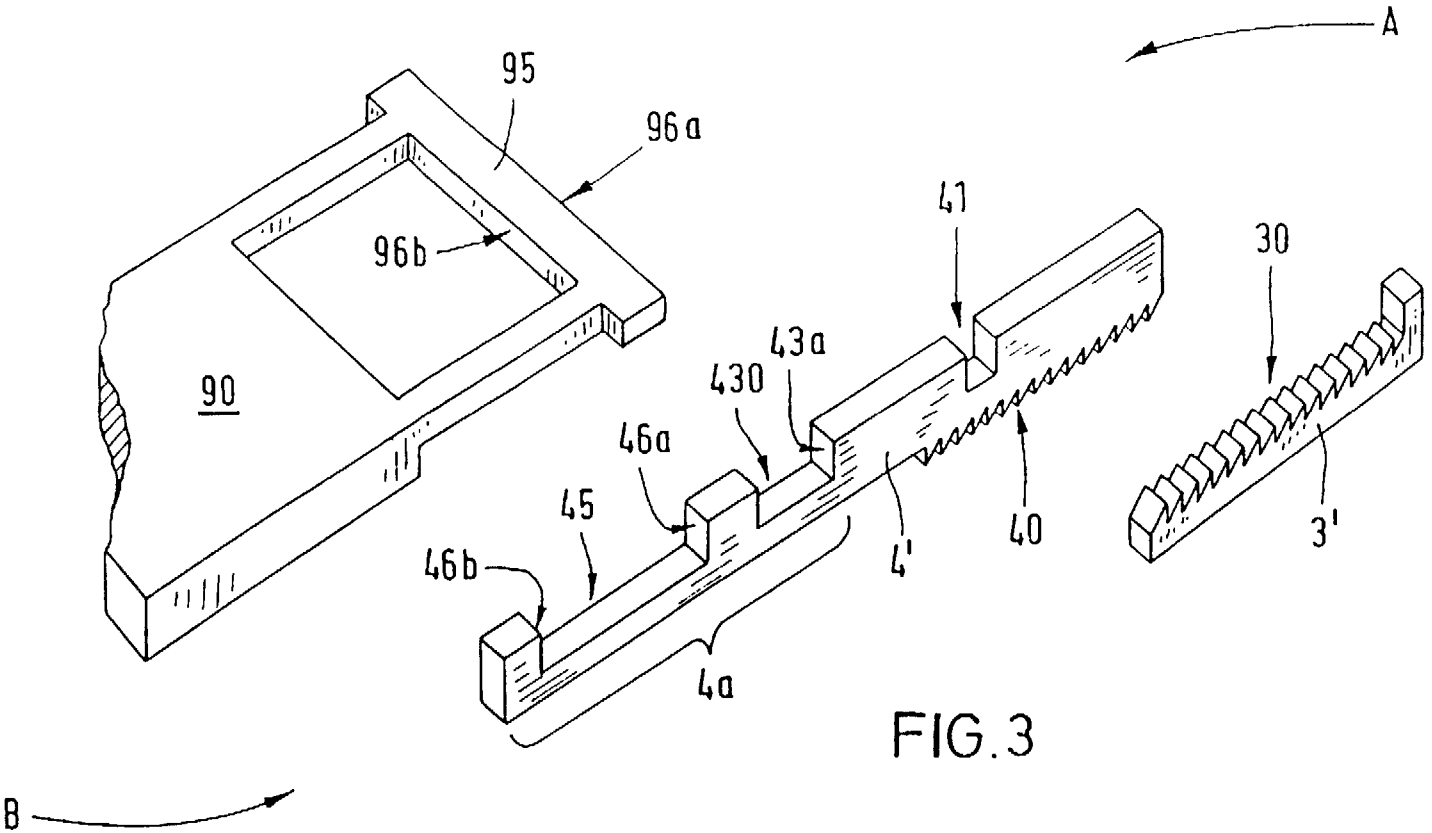
FIG. 3 is an exploded representation of a latching element comprising a carrier and rider, with a schematically-illustrated opening/closing bar.

FIGS. 3 and 4 show embodiments of the second variation of the invention, which relate to an emergency or panic locking system and can readily be combined with the above-described, first invention variation.

Correspondingly, the riders 4' have extensions 4*a*, which extend in the direction of the side B, where an opening/closing bar 90 integrated into the locking system is disposed. The carrier 3' and the rider 4' are again in form-fitting engagement with each other by way of their toothing 30, 40. As long as the relative position of the two parts 3, 4 was not locked, they can be displaced toward each other in order to transfer the code of the key to the locking core. In the process, the latching recess 41 of one of each of the riders 4 assumes its specific position, so that, when a key that fits is inserted, the latching recesses 41 of all of the riders 4 of the locking core create an alignment into which the latch of a latching element can drop.

The rider 4' shown in FIG. 3 has an inside recess 430 for seating a stop element that performs the same function as the stop element 7 in FIG. 1. Its surface 96*a* which is analogous to the stop surface 7*a* enters engagement with the stop surface 43*a* of the recess 430 during the coding process by means of the key. The outer recess 45 formed in the extension 4*a* is limited by the stop surfaces 46*a* and 46*b*.

During operation of the opening/closing bar 90 and due to its being drawn into a stop position on the side of the housing, the rib 95 of the bar acts on the stop surface 46*b* of the rider 4' with its stop surface 96*b*, causing the latching elements 3', 4' to be displaced counter to the spring force and the latching recesses 41 to be associated directly with the latch 51 of a latching or blocking element. The locking system can subsequently be operated by the, e.g., manual, rotation of the opening/closing bar 90. The distance between the stop surfaces 46*b* and the latching recesses 41 of the riders 4' is the same for all of the latching elements 3', 4'.

The distance between the stop surfaces 46*a*, 46*b* is selected such that the stop surface 96*a* of the rib 95 of the opening/closing bar 90 does not touch the stop surface 46*a* of the recess 45 when the latching elements 3', 4' are located in their forward, inoperative position (at stop 21—see FIG. 1). Of course, the distance can also selected to be greater. For example, the recess 45 can have such a width that the stop surface 96*a* does not come in contact with the stop surface 46*a* of the rider 4' even if a key is completely inserted on the opposite side A. The advantage of this would be that no axially-acting force is exerted on the opening/closing bar when the locking system is operated by a key.

Figure 4A:
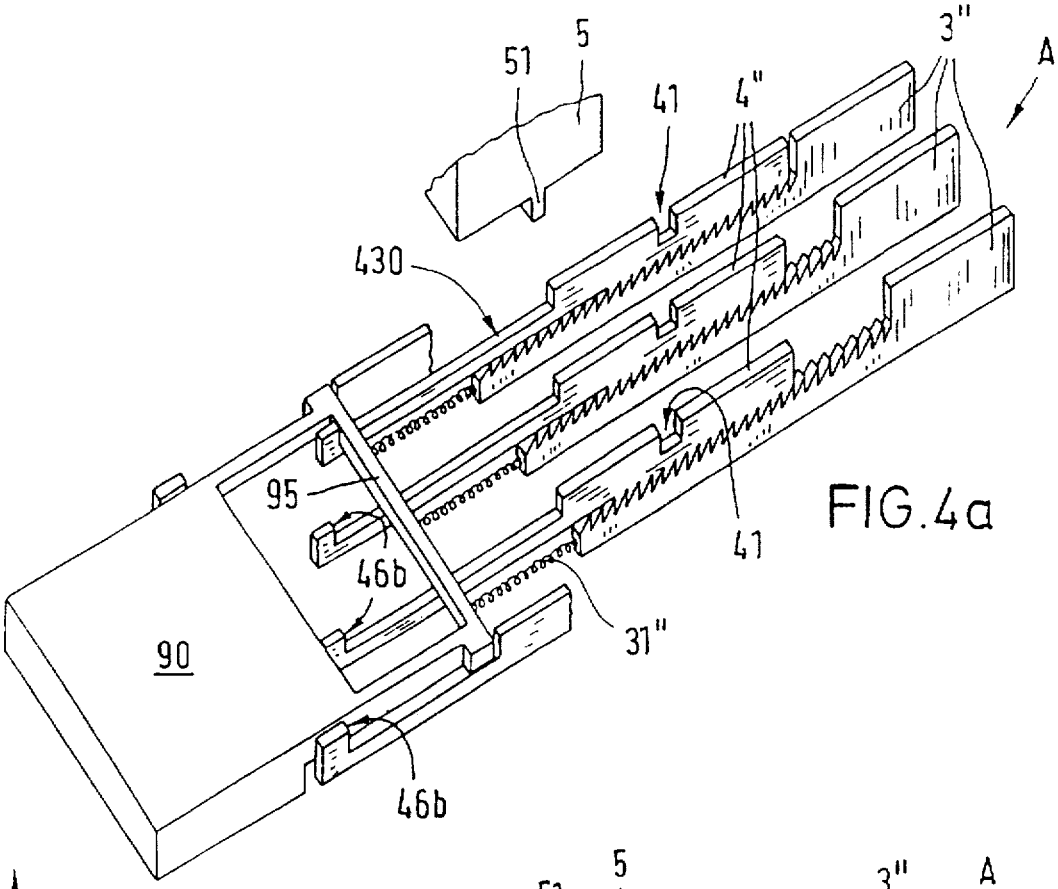
FIG. 4*a* is a schematic representation in perspective of coded latching elements in the inoperative position.
Figure 4B:
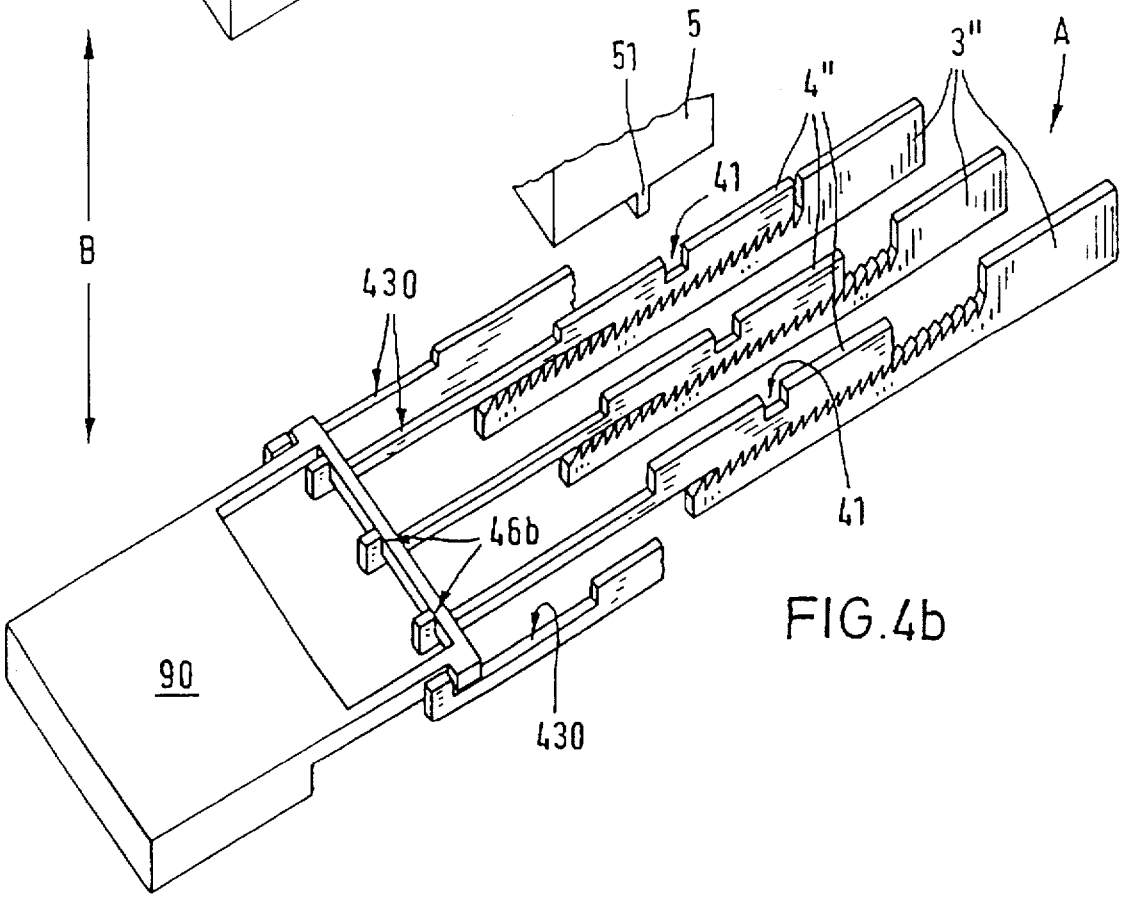
FIG. 4*b* is a schematic representation in perspective of coded latching elements during operation of the locking system by the opening/closing bar (emergency operation)

FIGS. 4*a* and 4*b* show schematic representations in perspective of the interior of a coded locking core, with carriers 3" and riders 4" of the individual latching elements 3", 4" being positioned with respect to each other to correspond to the length of the respective plunger of the key.

FIG. 4*a* shows the inoperative position, in which the carriers 3" are pressed against a front stop on the side A by the springs 31". In this inoperative position, the latching recesses 41 of the riders 4" are at different axially-oriented locations, corresponding to their coded setting, so that a lowering of the blocking element 5 is not possible; the latch 51 cannot extend into the latching recesses 41. Consequently, the locking system cannot be operated. A torque applied, e.g., manually to the opening/closing bar 90 and transmitted further to the latching elements 3", 4" by way of its rib 95 therefore cannot lead to a rotation of the locking core.

FIG. 4*b* shows the locking system in the unblocked position, in which all of the latching recesses 41 are adjacent, i.e., aligned and form a channel into which the latch 51 can extend. This locked position is achieved by pulling the opening/closing bar 90 into a stop. In the process, the stop surface 96*b* of the rib 95 acts on the stop surfaces 46*b* of the riders 4" and pulls them out of the inoperative position and into the unblocked position counter to the force of the springs 31". Now the blocking element 5 can be lowered radially, and the latch 51 can extend into the latching recess 41, by means of rotation of the opening/closing bar 90. Operation of the locking system, particularly emergency operation from the side B of the opening/closing bar 90, is thus possible.

Figure 5:
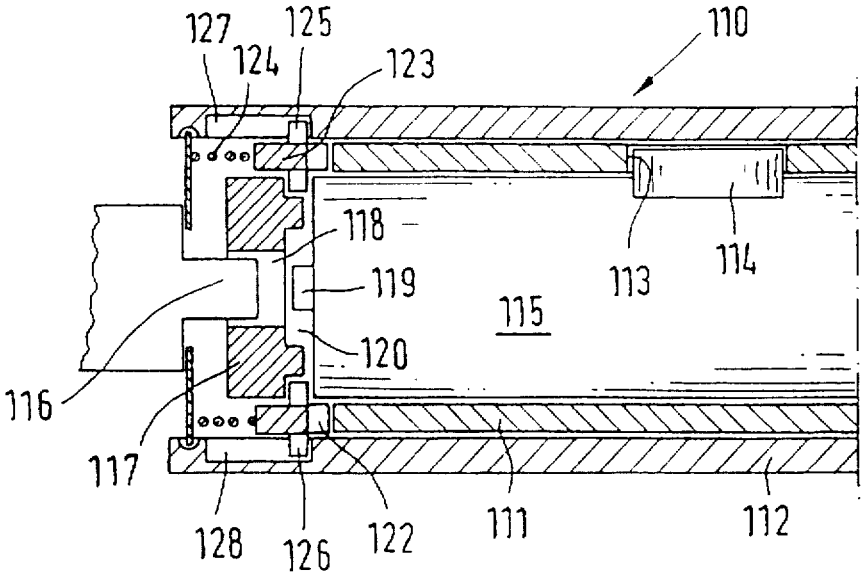
FIG. 5 is schematically, the longitudinal section of the rear-side part of the locking system of the invention, with a free-wheel apparatus.
Figure 5A:
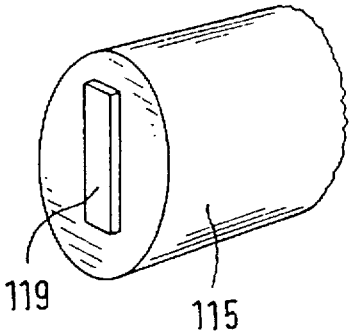
FIG. 5*a* is a view in perspective of the locking core end facing the free-wheel apparatus.
Figure 5B:
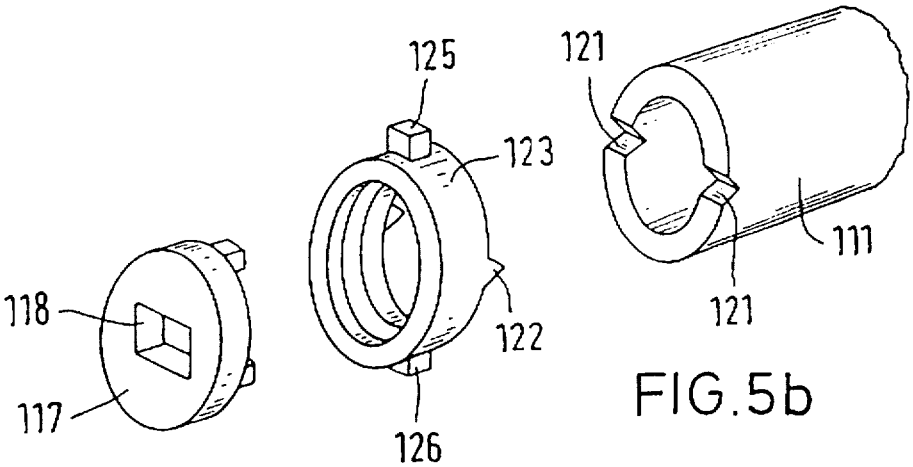
FIG. 5*b* is an exploded representation of the parts of the free-wheel apparatus according to FIG. 5 which are essential for function.

To prevent the blocking element 5 from being broken off by a corresponding introduction of force via the locking core in a locking cylinder located in the locking position, it has proven advantageous to provide the locking cylinder with a free-wheel apparatus. An apparatus of this type is illustrated in FIGS. 5 to 5*b*:

In this instance, the locking cylinder 110 has an inside cylinder 111 which is rotatably seated inside the housing 112. The inside cylinder 111 is provided with a recess 113, into which the blocking element 114 disposed on the locking core 115 extends (locked position of the locking cylinder).

The locking core 115 and the locking trunnion 116 of the lock, which is not shown in detail, are connected by way of an axially-displaceable carrier ring 117; the locking trunnion 116 projects form-fittingly into a first recess 118 of the carrier ring 117, and the locking core 115 projects form-fittingly into a second, oppositely-located recess 120 of the carrier ring 117 by way of a trunnion-shaped projection 119.

If the locking core 115 is now rotated violently, the inside cylinder 111 also rotates by way of the blocking element 114. By way of notches 121 of the inside cylinder 111 located on the side of the carrier ring, this cylinder presses against corresponding coupling-ring latches 122 of a coupling ring 123 connected to the carrier ring 117, so that the carrier ring 117 is pressed toward the locking trunnion 116 counter to the pressure of corresponding springs 124, and the trunnion-shaped projection 119 of the locking core 115 is no longer engaged in the carrier ring 17. A further rotation of the locking core 115 therefore no longer effects a rotation of the locking trunnion 116.

Sliding lugs 125, 126, which are guided in axial recesses 127, 128 of the housing 112, are provided on the coupling ring 123 in order to assure a linear displacement movement of the carrier ring 117.

If a key which fits the locking cylinder 110 is inserted into the corresponding key slot, the blocking element 114 is drawn into the locking core 115. When this key, and consequently the locking core 115, are rotated, the carrier ring 117 and the locking trunnion 116 of the lock are rotated (unlocked position) by way of the trunnion-shaped projection 119.

Figure 6:
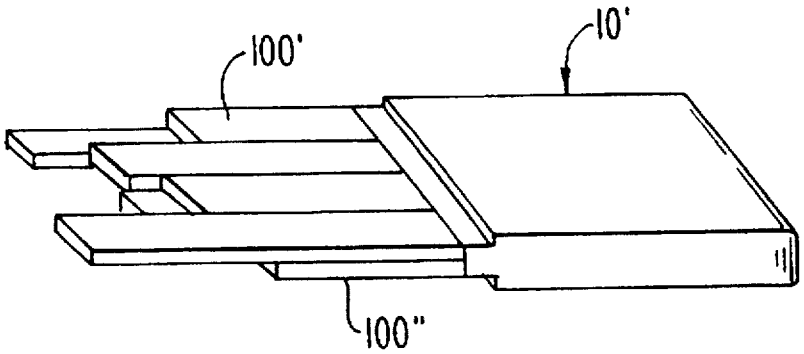
FIG. 6 is a perspective view of a reversible key for the locking system of FIG. 1.
Figure 6A:
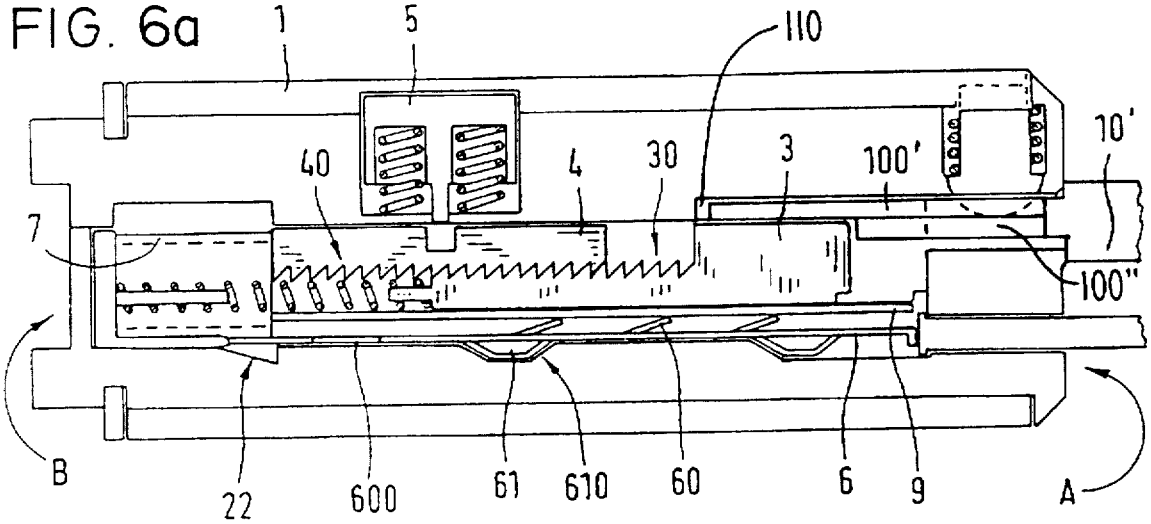
FIG. 6*a* is a cross sectional view of a modification of the locking system according to FIG. 1 in the same position as in FIG. 2*b* for use with a reversible key as shown in FIG. 6.

The invention is, of course, not limited to the described embodiments. Hence, it is also possible, for example, to use a turning or reversible key as the key to close and open the locking cylinder. This type of key 10' is shown in FIG. 6 and comprises a fixed base part into which the corresponding number of slides or plungers 100' and 100" are inserted from both sides so that the key 10' can be inserted in either direction. The locking cylinder must include a locking core which permits sufficient space for the plungers which do not displace the latching elements (3,4). Such an additional space 110 for one set of plungers, i.e., 100', is shown in FIG. 6*a*.

LIST OF REFERENCE NUMERALS

1—housing
10—key
100—plunger
2—locking core
2*a*—part of the base body of the locking core (top half)
2*b*—part of the base body of the locking core (bottom half)
20—recess
21—stop surface for carrier 3
22—cutout
23—front plate
24—floor
200*a*—inside base surface
200*b*—inside base surface
240—receiving pin for compression spring
3—carrier
3'—carrier
3"—carrier
30—toothed element
31—spring
4—rider
4'—rider
4"—rider
4*a*—rider extension
40—toothed elements
41—latching recess
43—stop surface
43*a*—stop surface
430—recess
45—recess
46*a*—stop surface
46*b*—stop surface
5—blocking element
5*a*—head region
50—recess
50*a*—recess
51—latch
52—spring
6—spring/fixing element
60—spring tongue
61—support block
62—pushing pin
600—detent spring
610—recess
7—stop element
7*a*—stop surface
8—distancing element
9—glide plate
9—opening//closing bar (inside key)
95—rib

96a—stop surface
96b—stop surface
110—locking cylinder, locking system
111—inside cylinder
112—housing
113—recess
114—blocking element
115—locking core
116—locking trunnion
117—carrier ring
118—recess
119—trunnion-shaped projection
120—recess
121—notch
122—coupling ring latch
123—coupling ring
124—spring
125, 126—sliding lugs
127, 128—recesses
A—side of the locking cylinder
B—side of the locking cylinder

We claim:

1. Locking system, particularly for motor vehicles and building fixtures, comprising a lock cylinder and a key which can be inserted into the lock cylinder and has plungers which point in the direction of insertion, wherein a locking core is rotatably seated in a housing, the core having at least one latching element which can be displaced, counter to a spring force, in the direction of insertion of the key, and which has a latching recess that can be engaged by the latch of a blocking element when the coded position of the latching element is reached, and wherein: the latching element comprises a carrier and a rider which can be displaced toward one another and are in frictional or form-fitting lockup, the latching recess associated with the latch is cut into the rider and a stop surface which is engaged by a stop element in an uncoded zero position of the latching element is provided at an outer free end of the rider, a spring/fixing element is provided which is supported on the one hand on an inside base surface of a base body of the locking core and, on the other hand, by the carrier, and the spring/fixing element can be brought into a fixing position in which the relative position of the carrier and the rider is fixed and the stop element is removed from its engagement with the stop surface of the rider.

2. Locking system according to claim 1, wherein the locking core comprises a first base body in which a spring-loaded blocking element is seated, and a second base body for receiving the spring-loaded latching elements.

3. Locking system according to claim 1, wherein a recess is associated with the blocking element in the insertion position of the key on a side of the housing, with the recess being bordered by gliding surfaces oriented inwardly and in the circumferential direction, so that a radial movement of the blocking element is caused when the locking core is rotated.

4. Locking system according to claim 2, wherein, in the uncoded zero position, the latching element comprising the carrier and the rider fills the distance between a stop surface at a front plate of the second base body and the stop element to the greatest extent possible.

5. Locking system according to claim 1, wherein the carrier and the rider are engaged by way of toothed elements and that the division of the toothed elements coincides with the distance between two adjacent code values.

6. Locking system according to claim 5, wherein the toothed elements are configured in sawtooth form, wherein the less steep tooth edges point in the direction of displacement during insertion of the key.

7. Locking system according to claim 1, wherein the spring/fixing element is displaceable, and includes spring elements configured as spring tongues which press in the direction of the carrier and support blocks into the opposite direction, and wherein the support blocks are seated in recesses of the base body in the uncoded zero position, while the support blocks are supported on the inside base surface of the base body in the coded position.

8. Locking system according to claim 7, wherein the height of the support blocks essentially corresponds to the free distance between the inside base surface and the carrier.

9. Locking system according to claim 7, wherein the spring/fixing element is embodied in one piece.

10. Locking system according to claim 7, wherein a pushing pin which projects through a front plate of the base body and engages the spring/fixing element with its inside end is provided for displacing the spring/fixing element into its fixing position.

11. Locking system according to claim 1, wherein the spring/fixing element is configured so as to be locked in its fixing position.

12. Locking system according to claim 11, wherein the spring/fixing element has a detent spring which latches in a recess of the base body in the fixing position.

13. Locking system according to claim 7, wherein a glide plate is provided between the spring/fixing element and the carrier.

14. Locking system according to claim 13, wherein spacing elements whose height at least corresponds to the height of the latching element comprising the carrier and the rider are disposed between the glide plate and an opposite base surface of the base body.

15. Locking system according to claim 14 wherein the glide plate and the spacing elements are embodied as a one-piece component.

16. Locking system according to claim 1, wherein all of the latching elements, or carriers and riders, of a locking system are of identical construction.

17. Locking system according to claim 1, wherein: the locking system includes a free-wheel apparatus so that the locking core and a locking trunnion of a lock connected to the locking system can be connected by way of an axially-displaceable carrier ring in the closed position of the locking system, the blocking element extends into a corresponding recess of an inside cylinder which is rotatably seated in the housing of the locking system, and the inside cylinder is provided on a carrier side with notches or latch-shaped projections which are engaged into corresponding projections or notches of a coupling ring coupled with the carrier ring, so that, during rotation of the inside cylinder, the coupling ring pushes the carrier ring far enough toward the lock that the locking core is no longer in engagement with the carrier ring.

18. Locking system according to claim 1, wherein enough space remains above or below the latching elements located in the locking core, which elements comprise a carrier and rider, that the locking system can also be operated with a reversible key.

19. Locking system, particularly for motor vehicles and building fixtures, comprising a lock cylinder and a key which can be inserted into the lock cylinder from one open side of the cylinder and has plungers that point in the direction of insertion, wherein a locking core is rotatably seated in a housing, the core having at least one latching element which can be displaced, counter to a spring force, in the direction of insertion of the key, the latching element having a latching recess which can be engaged by the latch of a blocking element when the coded position of the latching elements is reached, and wherein disposed on the other side of the lock cylinder is an opening/closing bar, which is movably mounted in the lock cylinder for movement in and counter to the direction of insertion and enters engagement with associated stop surfaces of the latching elements during operation of the bar for opening or closing of the locking system, wherein the distance between these stop surfaces and the latching recesses for the latch of the blocking element of all the latching elements is identical, and wherein the latching recesses of all of the latching elements are located in the position of engagement with respect to the latch of the blocking element in a stop position of the opening/closing bar.

20. Locking system according to claim 19, wherein the opening/closing bar is permanently integrated in the lock cylinder, wherein the locking system can be operated by the drawing of the opening/closing bar into its stop position on the other side of the housing, and subsequent rotation of the opening/closing bar and the lock cylinder.

21. Locking system according to claim 19, wherein: the latching element comprises a carrier and a rider which can be displaced toward one another and are in frictional or form-fitting lockup, the latching recess associated with the latching element is cut into the rider and a stop surface which is engaged by a stop element in an uncoded zero position of the latching element is provided at an end of the rider adjacent a second side of the lock cylinder, a spring/fixing element is provided which is supported between an inside base surface of a base body of the locking core and the carrier, the spring/fixing element can be brought into a fixing position in which the relative position of the carrier and the rider is fixed and the stop element is removed from its engagement with the stop surface of the rider, the rider has an extension in the direction of the second side of the cylinder, in whose side facing away from toothing are disposed a recess having the stop surface for the stop element and a further recess having a stop surface for a rib of the opening/closing bar.

22. Locking system according to claim 21, wherein the further recess has at least a width that corresponds to the sum of the width of the rib seated in this further recess and the maximum path of displacement of the carrier and the rider toward each other, and wherein the rib rests with its stop surface essentially against the stop surface of the further recess in the uncoded zero position.

* * * * *